US009387698B2

(12) United States Patent
Leighton et al.

(10) Patent No.: US 9,387,698 B2
(45) Date of Patent: Jul. 12, 2016

(54) PRINTER CONVECTION DRYER

(71) Applicant: XEROX CORPORATION, Norwalk, CT (US)

(72) Inventors: Roger G. Leighton, Hilton, NY (US); Michael F. Leo, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 15 days.

(21) Appl. No.: 14/339,898

(22) Filed: Jul. 24, 2014

(65) Prior Publication Data

US 2016/0023476 A1 Jan. 28, 2016

(51) Int. Cl.
*B41J 11/00* (2006.01)
*F26B 3/02* (2006.01)

(52) U.S. Cl.
CPC ..... *B41J 11/002* (2013.01); *F26B 3/02* (2013.01); *G03G 2215/00666* (2013.01)

(58) Field of Classification Search
None
See application file for complete search history.

(56) References Cited

U.S. PATENT DOCUMENTS

| | | | | |
|---|---|---|---|---|
| 4,501,072 | A | 2/1985 | Jacobi, Jr. et al. | |
| 5,154,010 | A | 10/1992 | Klemm | |
| 5,159,763 | A | 11/1992 | Platsch | |
| 5,537,925 | A | 7/1996 | Secor et al. | |
| 5,631,685 | A | 5/1997 | Gooray et al. | |
| 5,713,138 | A * | 2/1998 | Rudd | F26B 13/14 34/124 |
| 6,059,406 | A | 5/2000 | Richtsmeier et al. | |
| 6,067,726 | A | 5/2000 | Rogne et al. | |
| 6,463,674 | B1 | 10/2002 | Meyers et al. | |
| 7,303,273 | B2 | 12/2007 | Jurrens et al. | |
| 7,354,146 | B2 * | 4/2008 | Yraceburu | B41J 11/002 347/101 |
| 2014/0152750 | A1 * | 6/2014 | Shifley | B41J 11/002 347/102 |
| 2015/0174924 | A1 * | 6/2015 | Fuchioka | B41J 11/002 347/102 |

* cited by examiner

*Primary Examiner* — Bradley Thies
(74) *Attorney, Agent, or Firm* — Gibb & Riley, LLC

(57) ABSTRACT

A printed sheet drying apparatus includes, among other components, a nozzle connected to a heated air supply, and an exhaust chamber connected to the nozzle and to a blower. The nozzle comprises a heated air outlet portion. The heated air outlet portion comprises a multi-planar surface having parallel slot openings tapering away from the printed sheet to prevent saturation at the boundary layer. The exhaust chamber has an exhaust opening that matches the shape of the multi-planar surface, and the exhaust opening is larger than the nozzle and is positioned to form an exhaust periphery gap surrounding a periphery of the nozzle.

12 Claims, 7 Drawing Sheets

PRINTER CONVECTION DRYER

BACKGROUND

Systems and devices herein generally relate to printing devices and more particularly to printing devices that dry printed sheets.

Many times printers use marking material (e.g., inks, etc.) that transfer moisture (e.g., water or other materials that are in liquid form at internal operating temperatures of the printing device) into the printed sheets of media (such as paper, card stock, transparencies, etc.), and such moisture can be removed to prevent color non-uniformity, wrinkling, papers adhering to one another, paper jams, etc. For example, a cutsheet aqueous inkjet printer may dry printed sheets before output to prevent offset between the transport elements, sheet-to-sheet adhesion in a stacker, cockle (e.g., wrinkling) due to a water residing too long within the sheet, etc.

When drying sheets immediately after printing, a sufficient amount of heat is provided to raise the water temperature in the aqueous ink, while avoiding ignition of the printed sheets during a paper jam. The drying goals are first to remove the water that has been added by printing, second to prevent over-drying the plain non-jetted sheet (e.g., maintaining the overall relative humidity (Rh) to below a specified percentage, such as below 3%), third to maintain the internal humidity in the dryer cavity at a desirable percentage (e.g., 6% to 8%.) with different ambient Rh conditions, and fourth to remove the bulk moisture from the printer to the exterior of the building without creating a load on the HVAC of the building.

For example, a printed sheet drying system that uses a perforated vacuum belt results in relatively large conductivity of air near the perforations, whereas the other areas of the belt that are in direct contact with the sheet provide a much lower relative heat conductivity. These differences in conductivity can produce a thermal gradient, which will create different boundary conditions for drying and could result in low media weight prints having visible drying mottle on the backside of the page. Thus, if impingement holes are used to dry they could create mottle and non-uniformity on the front of the page.

Further, it is beneficial if the large air handling requirements of the drying system avoid disturbing the paper on the transport as it is moving under the dryer, so as to maintain expected sheet positions and arrival times.

SUMMARY

An exemplary printed sheet drying apparatus herein includes, among other components, a nozzle operatively (meaning directly or indirectly) connected to a heated air supply, and an exhaust chamber operatively connected to the nozzle and operatively connected to a blower. The nozzle comprises an enclosed portion and a heated air outlet portion. The heated air outlet portion comprises a multi-planar surface having parallel slot openings. The exhaust chamber has an exhaust opening that matches the shape of the multi-planar surface, and the exhaust opening is larger than the nozzle(s) and is positioned to form an exhaust periphery gap surrounding a periphery of the nozzle(s).

An exemplary printer herein includes, among other components, a printing engine using aqueous ink that outputs printed sheets. A transport is positioned in a location adjacent the printing engine so as to receive the printed sheets, and a drying apparatus is positioned in a location adjacent the transport so as to allow the printed sheets to pass between the drying apparatus and the transport.

The drying apparatus can include a heater producing a heated air supply, a first blower connected to the heater (directly or through a duct), and one or more nozzles connected to the heater. The nozzles receive the heated air supply from the heater at a relatively higher (e.g., first) atmospheric pressure that is created by the first blower blowing into the duct or nozzles. Also, the drying apparatus can include an exhaust chamber, that can be connected to and that supports the nozzles, and a second blower connected to the exhaust chamber that creates a relatively lower (e.g., second) atmospheric pressure within the exhaust chamber by drawing air out of the exhaust chamber (again, either directly or through a duct).

Each nozzle is rectangular and comprises a pressure chamber that can be in the form of a rectangular box-shaped "enclosed" portion that does not include any openings (except an opening to the duct through which the first blower blows the heated air) and a heated air "outlet" portion that has a multi-planar surface having parallel slot openings. In one example, the multi-planar surface of the pressure chamber comprises a first planar portion and a second planar portion meeting at a midline, and the midline is parallel to the parallel slot openings. The midline thus comprises a portion of the multi-planar surface that extends the greatest amount from the interior of the pressure chamber in a similar way that an A-frame roof extends from a structure that it covers.

Also, the exhaust chamber has an exhaust opening that matches (but is larger than) the shape of the perimeter of the one or more multi-planar surfaces. Thus, the exhaust opening comprises a rectangular-shaped item having a shape that matches the perimeter of the one or more multi-planar surface(s).

Further, the rectangular nozzles are positioned within, and supported by, the exhaust opening, are parallel to one another, and are at a distance apart from one another so as to create inter-nozzle gaps between the nozzles. Also, the exhaust opening is larger than the one or more rectangular nozzles and is positioned so as to form an exhaust periphery gap located at a periphery of the exhaust opening and surrounding the one or more nozzles.

These and other features are described in, or are apparent from, the following detailed description.

BRIEF DESCRIPTION OF THE DRAWINGS

Various exemplary systems and devices are described in detail below, with reference to the attached drawing figures, in which.

DETAILED DESCRIPTION

As mentioned above, with printed sheet dryers there is often difficulty in removing the water vapor from the boundary layer, preventing saturation at the boundary, maintaining the internal humidity in the dryer cavity at a desirable percentage, and removing the bulk moisture from the printer to the exterior of the building without creating a load on the HVAC of the building, etc. Therefore, this disclosure presents a dryer device and system for use inside a printing device that uniformly dries the center and the perimeter of the sheets (without risk of igniting the sheets) while simultaneously reducing the heat that is output to the external areas surrounding the printing device. More specifically, the drying physics that enable successful sheet drying raise the paper and unbound water temperature in the surface boundary layer of the paper, without saturating the boundary layer and removing the moisture within the dwell time of the dryer chamber.

Figure 1:
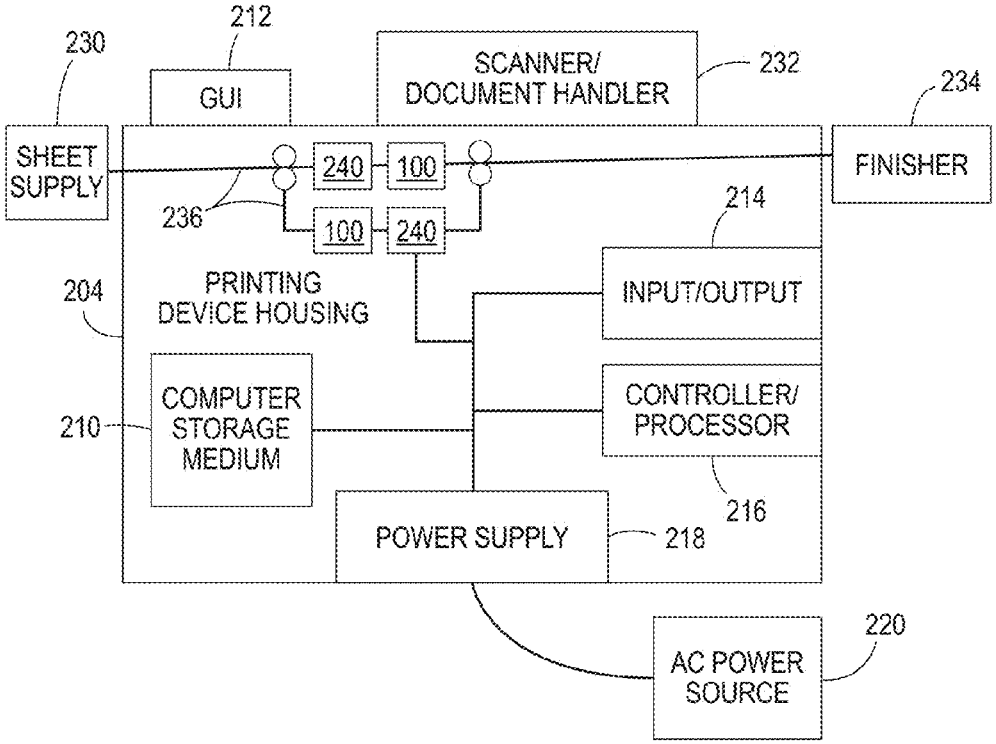
FIG. 1 is a schematic diagram illustrating a printing device herein.

FIG. 1 illustrates a computerized device that is a printing device 204, which can be used with systems and devices herein and can comprise, for example, a printer, copier, multi-function machine, multi-function device (MFD), etc. The printing device 204 includes a controller/tangible processor 216 and a communications port (input/output) 214 operatively connected to the tangible processor 216 and to the computerized network 202 external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 216 controls the various actions of the computerized device. A non-transitory, tangible, computer storage medium device 210 (which can be optical, magnetic, capacitor based, etc., and is different from a transitory signal) is readable by the tangible processor 216 and stores instructions that the tangible processor 216 executes to allow the computerized device to perform its various functions, such as those described herein. Thus, as shown in FIG. 1, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 and sheet dryer(s) 100, both operatively connected to the tangible processor 216, a media path 236 positioned to supply continuous media or sheets of media from a sheet supply 230 to the marking device(s) 240, etc. After receiving various markings from the printing engine(s) 240 and being dried by the sheet dryer(s) 100, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operates on the power supplied from the external power source 220 (through the power supply 218).

The one or more printing engines 240 are intended to illustrate any marking device that applies a marking material (e.g., aqueous inks, liquid inks, etc.) to continuous media or sheets of media, whether currently known or developed in the future. As would be understood by those ordinarily skilled in the art, the printing device 204 shown in FIG. 1 is only one example and the systems and devices herein are equally applicable to other types of printing devices that may include fewer components or more components. For example, while a limited number of printing engines and paper paths are illustrated in FIG. 1, those ordinarily skilled in the art would understand that many more paper paths and additional printing engines could be included within any printing device used with systems and devices herein.

Figure 2:
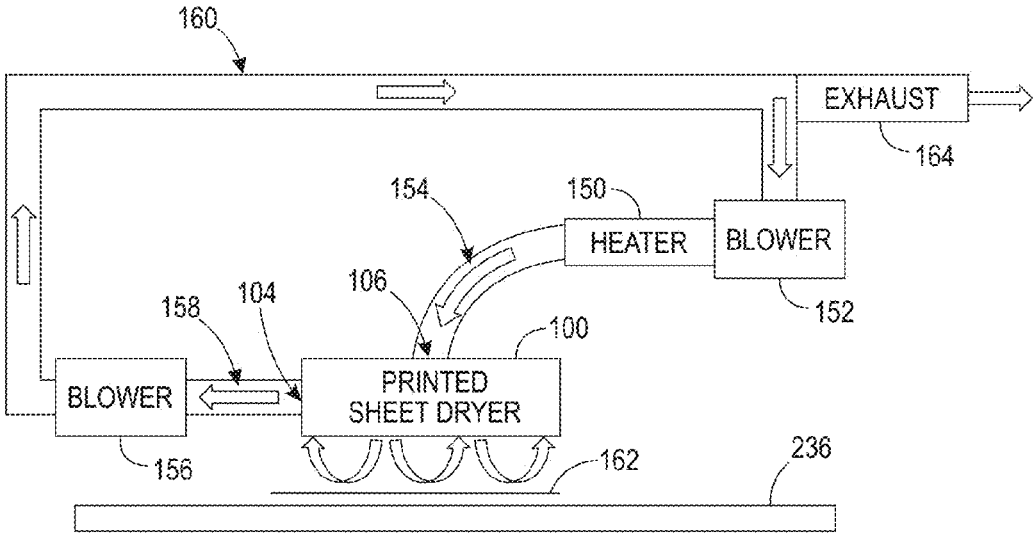
FIG. 2 is a schematic diagram illustrating a drying device herein.

FIG. 2 illustrates the sheet dryer 100 system, mentioned above, in greater detail. More specifically, a heater 150 generates heated air that is supplied to an inlet 106 of the printed sheet dryer 100. An optional blower 152 and duct 154 can be connected in many different arrangements (only one of which is shown in FIG. 2) in order to supply the heated air (represented by a curved block arrow within duct 154) to the inlet 106. Additionally, an optional secondary blower 156 can be connected to an outlet 104 of the sheet dryer 100 (and can be optionally connected to the outlet by way of an optional duct 158). As shown by the block arrow within duct 158, the blower 156 draws air away from the printed sheet dryer 100.

Thus, FIGS. 1 and 2 illustrate an exemplary printer that includes, among other components, printing engine(s) 240 using a potentially aqueous ink that outputs printed sheets 162 to the finisher 234. The potentially heated transport (e.g., heated rollers, heated belts, etc.) 236 is positioned in a location adjacent the printing engine 234 so as to receive the printed sheets 162, and the drying apparatus 100 is positioned in a location adjacent the transport 236 so as to allow the printed sheets 162 to pass between the drying apparatus 100 and the transport 236.

The curved block arrows below the printed sheet dryer 100 illustrates that, by operation of the heated air being forced into the inlet 106 and being drawn out of the outlet 104, the heated air is forced out of the printed sheet dryer 100 to a sheet of media 162 traveling upon the media path 236 and then drawn back into the printed sheet dryer 100. The media path 236 can comprise any form of media transport device, such as rollers, belts, vacuum devices, air powered devices, etc., and such devices can optionally be heated.

One feature of the devices and systems herein is that the air supplied to the inlet 106 can be maintained at a temperature below the ignition point of the print media. For example, with printing on paper, the temperature of the heated air supplied to the inlet 106 can be maintained below 235° C., the ignition point of paper (and to provide an additional margin of safety and to avoid detrimentally affecting co-solvents in the ink, can be maintained below 175° C., 150° C., 125° C., etc.).

Further, this heated air is constantly recirculated back to the heater 150 using, for example, optional duct 160 which forms a recirculation system (and the direction of airflow within duct 162 is represented by block arrows). This recirculation system 160 potentially allows one of the blowers 152, 156 to be eliminated. Additionally, the recirculation system 160 reduces the amount of energy the heater 150 consumes because the air returning through duct 160 has been previously heated by the heater 150 and is, therefore, at an elevated temperature relative to the internal operating temperature of the printing device 204 (which is generally between 40° C. and 75° C., and is often at, for example, 70° C.).

Also, the combination of the printed sheet dryer 100 drawing in heated air and the recirculation system 160 reduces the amount of heated air that is released into internal operating areas of the printing device (and this, in turn, reduces the temperature of the heated air that is exhausted to the area external to the printing device). By reducing the amount of heat exhausted from the printing device, this reduces the load upon the cooling system of the building in which the printing devices located, thereby further promoting reduced power consumption. An exhaust opening in the recirculation path allows for only a limited percentage (e.g., 20%, 30%, 40%, etc.) of the returning air to exit the building that is moisture laden. The amount of moisture laden air exiting this otherwise closed system is automatically controlled using an automated damper or passive exhaust opening 164. These exhaust gases output from exhaust 164 can be directly piped into the buildings HVAC to be sent directly outside the building. The dryer will draw a corresponding percentage of new air (e.g., makeup) from the interior of the machine/building.

By operation of the one or more blowers 152, 156, constantly circulating the heated air, the area between the printed sheet dryer 162 and the media path 236 will be maintained at the temperature of the heated air. Thus, even if a sheet of media remains beneath the printed sheet dryer 100 because of a malfunction or jam, the constant circulation of air prevents the temperature from rising above the controlled temperature of the heated air (and keeps humidity levels constant (and at a controlled level) across the entire opening of the dryer 100). To the contrary, other types of heating systems that place the heating elements in close proximity to the print media can inadvertently cause the print media to rise above the ignition temperature (especially in the case of a malfunction (e.g., paper jam) that causes the print media to remain adjacent the high temperature heating elements). Therefore, with the sheet dryer devices and systems herein, there is no risk of igniting the print media, even in the case of a paper jam malfunction where the sheet dryer continues to apply heat to the jammed sheet.

While FIG. 2 illustrates one exemplary arrangement of a heater, blowers, ductwork, etc., those ordinarily skilled in the art would understand that the claims presented below apply to any arrangement of one or more heaters and blowers, systems that avoid ductwork, systems that utilize more ductwork, systems that utilize multiple sheet dryers positioned in series; and FIG. 2 is intended to illustrate all such arrangements and extensions that would be understood from the limited example presented in FIG. 2.

Different views of the printed sheet dryer 100 are presented in FIGS. 3-10 in order to illustrate additional features of the devices herein. As shown, for example, in perspective view in FIGS. 3-4 and cross-sectional view in FIG. 5, the printed sheet drying apparatus 100 includes, one or more rectangular nozzles 110 connected to the heater 150 through the inlet 106 (and potentially through the duct 154). Thus, the nozzles 110 receive the heated air supply from the heater 150 at a relatively higher (e.g., first) atmospheric pressure that is created by the first blower 152 blowing into the duct 154 or directly into the nozzles 110.

Figure 5:
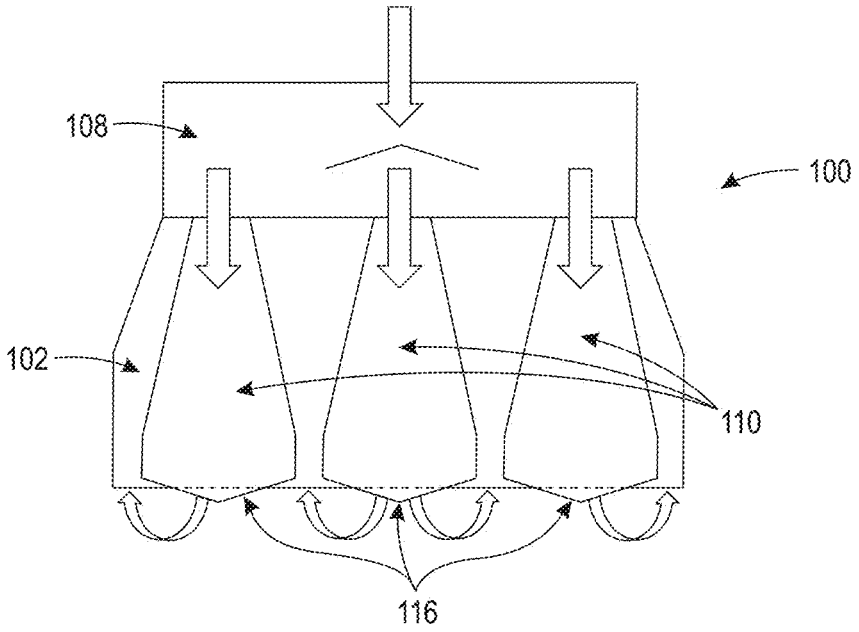
FIG. 5 is a schematic diagram illustrating a drying device having nozzles herein.
Figure 6:
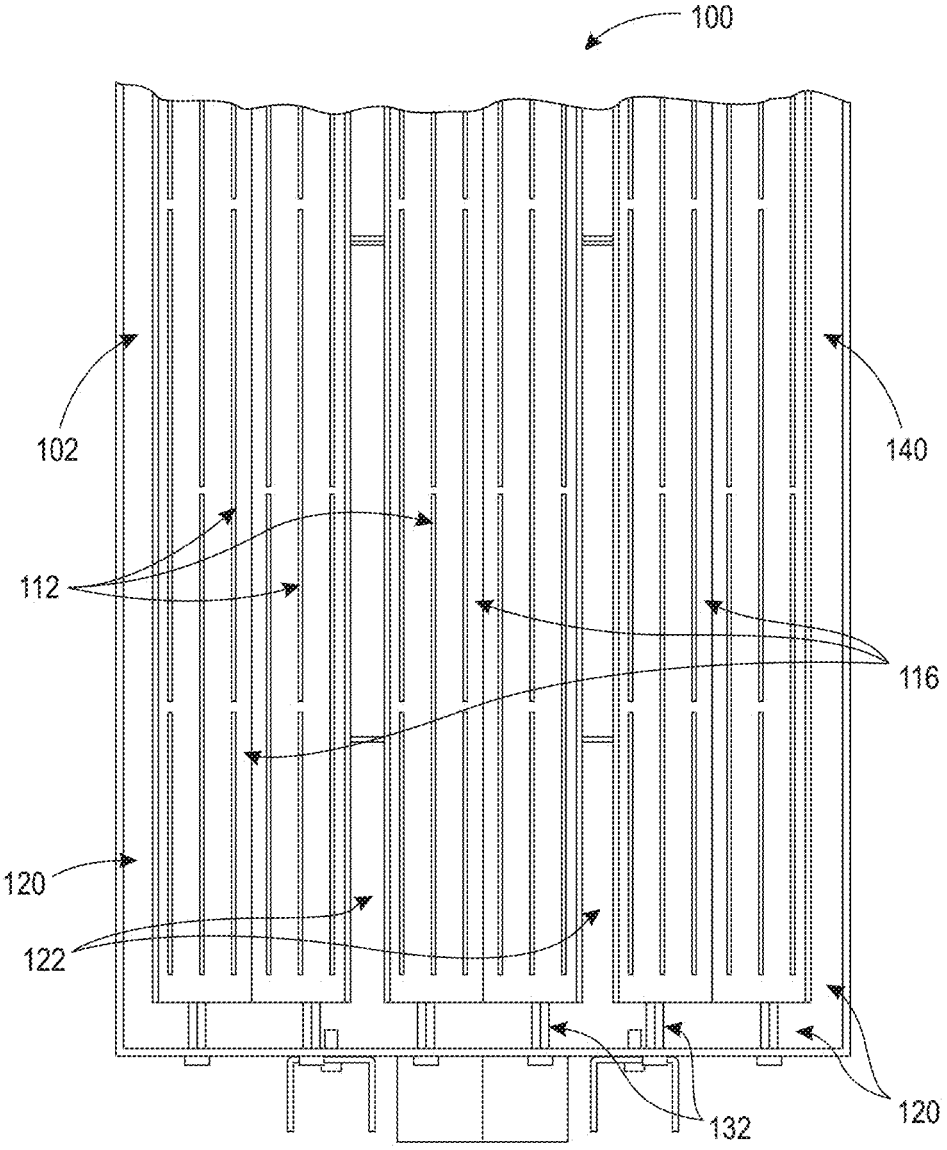
FIG. 6 is a schematic diagram illustrating nozzles herein.

As shown most clearly in the cross-sectional view in FIG. 5, the drying apparatus includes an exhaust chamber 102 and a pressure chamber 108. The exhaust chamber 102 includes support connectors 132 (bolts, screws, rods, etc.) that can be connected to and that support the nozzles 110. The second blower 156 (if so equipped) is directly or indirectly connected to the exhaust chamber 102 (potentially using duct 158) that creates a relatively lower (e.g., second) atmospheric pressure within the exhaust chamber 102.

The first atmospheric pressure in the pressure chamber 108 is higher than the operating atmospheric pressure within the printer 204. The second atmospheric pressure in the exhaust chamber 102 is lower than the operating atmospheric pressure within the printer 204. Thus, the higher first atmospheric pressure forces the air out of the nozzles 110 and the lower second atmospheric pressure draws the heated air that is output from the nozzles 110 into the exhaust chamber 102, as shown by the block arrows in the drawings.

Figure 3:
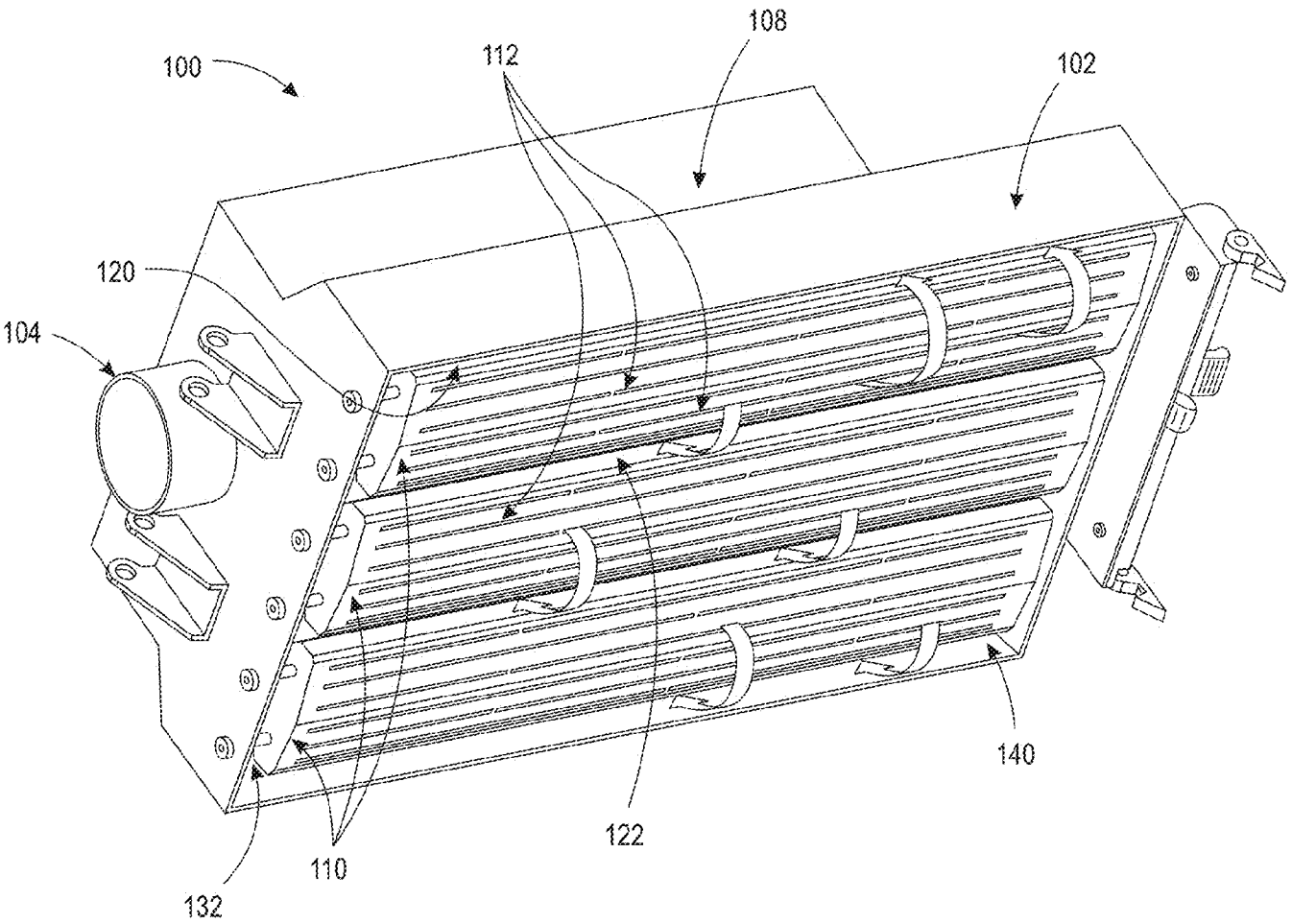
FIG. 3 is a schematic diagram illustrating a drying device having nozzles herein.
Figure 4:
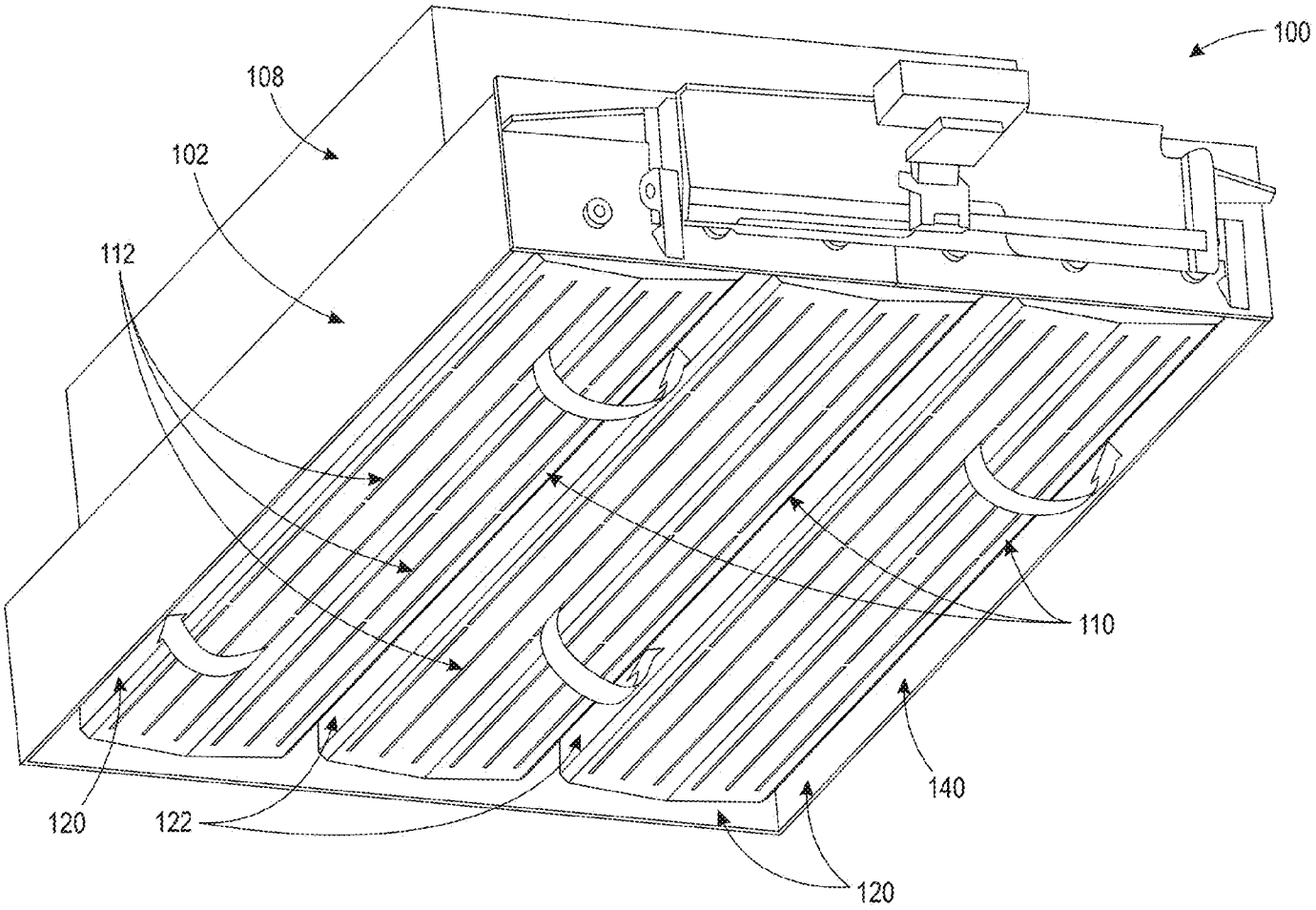
FIG. 4 is a schematic diagram illustrating a drying device having nozzles herein.

FIGS. 3-5 illustrate 3 nozzles 110 within the exhaust chamber 102, and those ordinarily skilled in the art would understand that there could be any number of nozzles 110 within the exhaust chamber 102 (e.g., a single nozzle 110, two nozzles, five nozzles, eight nozzles, etc.). As shown in the cross-sectional view in FIG. 5 and the bottom view in FIG. 6, each nozzle 110 has rectangular bottom shape, and each nozzle 110 comprises a pressure chamber that can be in the form of a rectangular box-shaped "enclosed" portion that does not include any openings (except an opening (the inlet 106) to the duct 154 through which the first blower 152 blows the heated air) and a heated air "outlet" portion that has a multi-planar (tapered) surface 116 having parallel slot openings 112.

Also, the exhaust chamber 102 has an exhaust opening 140 that matches (but is larger than) the shape of the perimeter of the one or more multi-planar surfaces 116. Thus, the exhaust opening 140 comprises a rectangular-shaped item having a shape that exceeds the area of the combined nozzles 110, allowing the capture of the heated moisture laden air within the dryer.

Further, the rectangular nozzles 110 are positioned within, and supported by, the exhaust opening 140, are parallel to one another, and are at a distance apart from one another so as to create inter-nozzles gaps 122 between the nozzles 110. Also, the exhaust opening 140 is larger than the one or more rectangular nozzles 110 and is positioned so as to form an exhaust periphery gap 120 located at a periphery of the exhaust opening 140 and surrounding the one or more nozzles 110.

Figure 7:
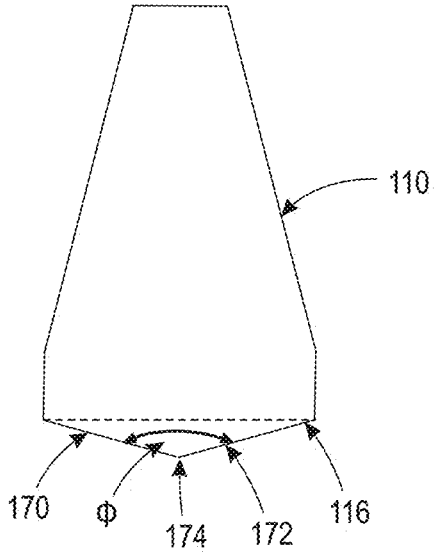
FIG. 7 is a schematic diagram illustrating a nozzle herein.
Figure 8:
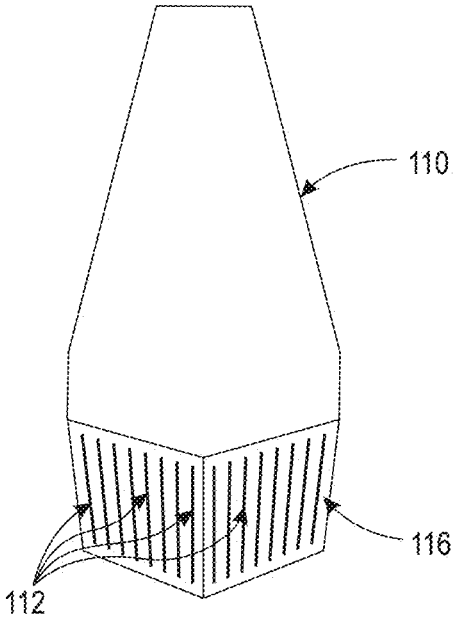
FIG. 8 is a schematic diagram illustrating a nozzle herein.

FIGS. 7 and 8 illustrate, respectively, cross-sectional and perspective views of one of the nozzles 110. As shown in FIGS. 7 and 8, the multi-planar surface 116 of the pressure chamber comprises a first planar portion 170 and a second planar portion 172 meeting at (tapered at) a midline 174, and the midline 174 is parallel to the parallel slot openings 112. The midline 174 thus comprises a portion of the multi-planar surface 116 that extends the greatest amount from the interior of the pressure chamber 114 in a similar way that an A-frame roof extends from a structure that it covers. Thus, the first planar portion 170 forms an angle Ø with the second planar portion 172 (where the angle Ø is greater than 0°).

Figure 9:
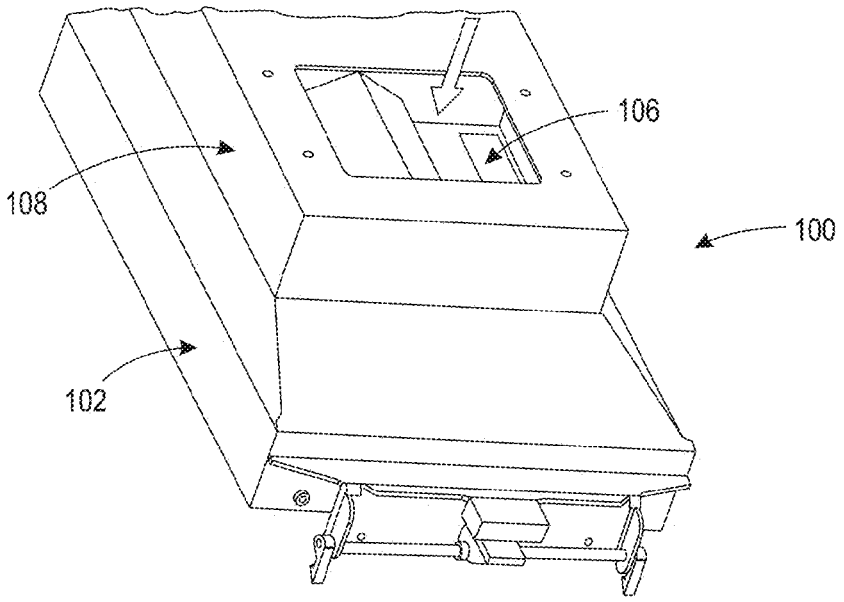
FIG. 9 is a schematic diagram illustrating a drying device herein.
Figure 10:
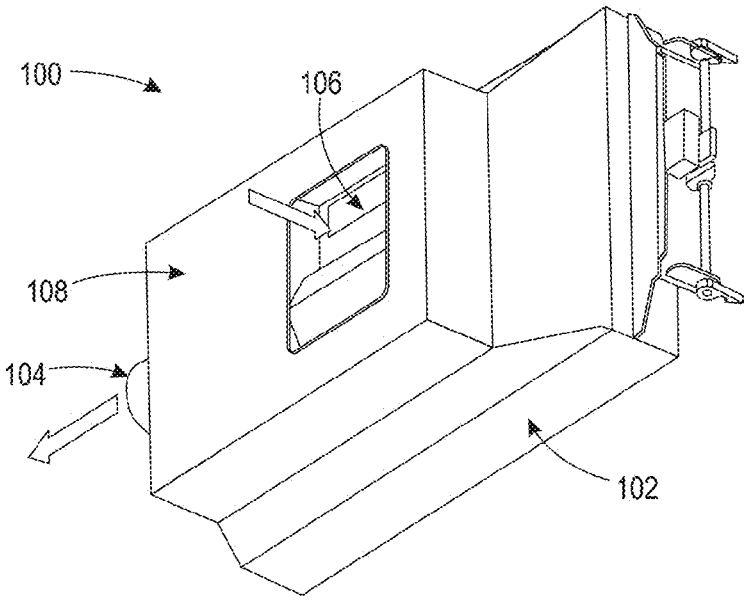
FIG. 10 is a schematic diagram illustrating a drying device herein.

FIGS. 9 and 10 are perspective drawings that illustrate, from different angles, the exterior of the pressure chamber 108, vacuum chamber 102, exhaust opening 104, inlet 106, etc.

Therefore, as shown above, the structures disclosed herein provide a tapered slot 112 jet nozzle 100 that can be formed simply in sheet metal fabrication devices. These structures provide a tapered exhaust area 116 that prevents local water vapor saturation at the boundary layer. The taper (at 174) provides additional characteristic length decreasing premature water concentration/saturation under the slots. The saturation at the boundary layer that is limited by the tapered exhaust area 116 can reduce effective evaporation and mass transfer, thus reducing dryer efficiency (and the tapered exhaust area 116 reduces such saturation). The taper (at 174) also helps to sweep the vapor at the boundary layer by limiting slot-to-slot competition and interaction. During drying with the structures disclosed herein, the moisture-laden gases get pulled to each side of the nozzles 110 via the exhaust low pressure along the full width of the dryer, which prevents stagnation zones. The perimeter area 120 and area 122 between the slot jet nozzles 110 assembly and on each end (and at the paper entrance and exit) prevents hot escaping gases from seeping into the machine cavity and, therefore, the drying apparatuses discussed herein avoid drying out the liquid inks within the printheads.

More specifically, with the nozzles 110 described above, the downward velocity of the heated air flowing from the slots 112 provides the air pressure to maintain the printed sheets 162 in the correct position on the heated conveyor rollers. The heated conveyor (e.g., rollers) 236 provides a continuously rotating surface so mottle imprinting does not occur (due to conduction gradients).

Therefore, the structures discussed herein provide directed high velocity impingement air that can be controlled to be well below any ignition point (e.g., >180° C.; >150° C.; >125° C.; etc.) producing heat transfer safely without the risk of igniting the print media. Further, each air flow nozzles 110 is positioned within the exhaust opening 140 to create gaps between each nozzles 110 assembly, thereby allowing air to be drawn into the exhaust opening 140 easily after drying the printed sheets of media.

When drying printed sheets, moisture is removed from the sheet as well as water from the ink. For example, some inks can be above 50% water, with the balance being co-solvents of glycol, glycerin, and solids. The boiling points of the glycol and glycerin are above 200° C., and the co-solvents generally do not evaporate during the low temperatures that occur during printing 55° C. Therefore, because the structures presented herein allow lower temperature heated air (e.g., 150° C.) to be utilized and still achieve full drying capability, the structures herein are effective at removing water, without affecting the co-solvents. Thus, the structures herein help lower the viscosity of the co-solvents to drive the co-solvents into the paper fiber in coordination with the capillary pull of the fibers, and help limit ink offset within the transport nip roller drive.

Further, as shown in the above drawings, the multi-planar surface 116 of the nozzles 110 is tapered from the middle (at 174) to increase the amount of dry air immediately adjacent to the printed media sheet, and to provide a directional path for the air across the full width of the print media to dry peripheral areas of the printed sheet. Thus, the tapering of the multi-planar surface 116 of the nozzles 110 helps move the heated air across all areas of the printed sheet evenly before the heated air moves to the lower pressure exhaust areas, preventing paper ignition and providing uniform temperature and humidity across all areas of the sheet being dried.

Additionally, by placing the nozzles 110 directly across the media path from the heated transport rollers, the nozzles 110 provide air pressure that pushes the printed sheets into (e.g., toward) the heated transport rollers, helping maintain the printed sheets in the correct location within the media path. Further, with the structures herein, the exhaust flow is constrained, to avoid the leading edge of the sheet from being picked up in the front or exit of the dryer (which might otherwise result in a sheet jam).

The perimeter gap 120 the perimeter of the exhaust opening 140 and the perimeters of the one or more nozzles 110 (as well as the gaps 122 between the nozzles 110) creates a perimeter curtain of negative pressure that captures the heated air before it can exhaust into other areas of the machine (such as ink containers, where excessive heat could undesirably affect inks). Therefore, the perimeter gap 120 and the inter-nozzles gaps 122 substantially prevent escaping heated gases from entering other locations of the printer, and instead such heated air is either directed to a location outside the printer (or outside the building), or redirected back to be reused within the nozzles 110.

The convective dryer structure 100 disclosed herein additionally provides the option to recirculate the heated gases and some additional moisture by introducing air captured by the exhaust structure back into the heated air produced by the heater. Therefore, with the use of sensors, the temperature and humidity of the heated air being directed toward the printed sheets 162 can be made uniform across the entire sheet being dried, and easily controlled. Further, by recirculating the heated air, less energy is required to heat the air, and less heat is output through an external exhaust of the printer. This reduces cooling demand of the HVAC system in which the printer is located. The exhaust gases that are exiting the building are replaced by makeup air within the building.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and devices described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and devices herein can encompass systems and devices that print in color, monochrome, or handle color or monochrome image data. All foregoing systems and devices are specifically applicable to electrostatographic and/or xerographic machines and/or processes.

Further, an image output device is any device capable of rendering the image. The set of image output devices includes digital document reproduction equipment and other copier systems as are widely known in commerce, photographic production and reproduction equipment, monitors and other displays, computer workstations and servers, including a wide variety of color marking devices, and the like.

To render an image is to reduce the image data (or a signal thereof) to viewable form; store the image data to memory or a storage device for subsequent retrieval; or communicate the image data to another device. Such communication may take the form of transmitting a digital signal of the image data over a network.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and devices herein cannot be implied or imported from any above example as limitations to any particular order, number, position, size, shape, angle, color, or material.

What is claimed is:

1. A printed sheet drying apparatus comprising:

at least two nozzles connected to a heated air supply; and an exhaust chamber connected to said nozzles, and operatively connected to a blower, each of said nozzles comprising a heated air outlet portion, each said heated air outlet portion comprising a rectangular multi-planar surface having parallel slot openings, each said rectangular multi-planar surface comprising a first planar portion and a second planar portion forming a tapered surface meeting at a midline, each said midline comprising a portion of said rectangular multi-planar surface that extends a greatest amount from an interior of said nozzles, said exhaust chamber having a rectangular exhaust opening matching a combined exterior perimeter of said rectangular multi-planar surface of said nozzles, and said rectangular exhaust opening being larger than said combined exterior perimeter of said rectangular multi-planar surface of said nozzles and positioned to form an exhaust periphery gap surrounding said combined exterior perimeter of said rectangular multi-planar surface of said nozzles.

2. The printed sheet drying apparatus according to claim 1, each said tapered surface of each said rectangular multi-planar surface directing air from said parallel slot openings to said exhaust periphery gap.

3. The printed sheet drying apparatus according to claim 1, each said first planar portion and each said second planar portion being at an angle relative to one another to direct air from said parallel slot openings to said exhaust periphery gap.

4. A printed sheet drying apparatus comprising:

at least two nozzles connected to a heated air supply; and an exhaust chamber connected to said nozzles, and operatively connected to a blower, said nozzles maintaining said heated air supply at a higher atmospheric pressure relative to said exhaust chamber, each of said nozzles comprising a heated air outlet portion, each said heated air outlet portion comprising a rectangular multi-planar surface having parallel slot openings, each said rectangular multi-planar surface comprising a first planar portion and a second planar portion forming a tapered surface meeting at a midline, each said midline comprising a portion of said rectangular multi-planar surface that extends a greatest amount from an interior of said nozzles, said parallel slot openings being parallel to each other and to said midline, said exhaust chamber having a rectangular exhaust opening matching a combined exterior perimeter of said rectangular multi-planar surface of said nozzles, and said exhaust opening being larger than said combined exterior perimeter of said rectangular multi-planar surface of said nozzles and positioned to form an exhaust periphery gap surrounding said combined exterior perimeter of said rectangular multi-planar surface of said nozzles.

5. The printed sheet drying apparatus according to claim 4, each said tapered surface of each said rectangular multi-planar surface directing air from said parallel slot openings to said exhaust periphery gap.

6. The printed sheet drying apparatus according to claim 4, each said first planar portion and each said second planar portion being at an angle relative to one another to direct air from said parallel slot openings to said exhaust periphery gap.

7. A printed sheet drying apparatus comprising:

a heater producing a heated air supply;

a first blower connected to said heater;

at least two nozzles connected to said heater and receiving said heated air supply from said heater at a first pressure created by said first blower;

an exhaust chamber connected to said nozzles; and a second blower connected to said exhaust chamber creating second pressure within said exhaust chamber, said first pressure being relatively higher than said second pressure, each of said nozzles comprising a heated air outlet portion, each said heated air outlet portion comprising a rectangular multi-planar surface having parallel slot openings, each said rectangular multi-planar surface comprising a first planar portion and a second planar portion forming a tapered surface meeting at a midline, each said midline comprising a portion of said rectangular multi-planar surface that extends a greatest amount from an interior of said nozzles, said exhaust chamber having a rectangular exhaust opening matching a combined exterior perimeter of said rectangular multi-planar surface, said nozzles being positioned within said exhaust opening at a distance apart to create inter-nozzle gaps between said nozzles, and said exhaust opening being larger than said combined exterior perimeter of said rectangular multi-planar surface of said nozzles and positioned to form an exhaust periphery gap surrounding said combined exterior perimeter of said rectangular multi-planar surface of said nozzles.

8. The printed sheet drying apparatus according to claim 7, each said tapered surface of each said rectangular multi-planar surface directing air from said parallel slot openings to said exhaust periphery gap.

9. The printed sheet drying apparatus according to claim 7, each said first planar portion and each said second planar portion being at an angle relative to one another to direct air from said parallel slot openings to said exhaust periphery gap.

10. A printer comprising:

a printing engine using aqueous ink outputting printed sheets;

a heated transport positioned in a location adjacent said printing engine to receive said printed sheets; and a drying apparatus positioned in a location adjacent said heated transport to allow said printed sheets to pass between said drying apparatus and said heated transport, said drying apparatus comprising:

a heater producing a heated air supply;

a first blower connected to said heater;

at least two nozzles connected to said heater and receiving said heated air supply from said heater at a first pressure created by said first blower; an exhaust chamber connected to said nozzles; and a second blower connected to said exhaust chamber creating second pressure within said exhaust chamber, said first pressure being relatively higher than said second pressure, each of said nozzles comprising a heated air outlet portion, each said heated air outlet portion comprising a rectangular multi-planar surface having parallel slot openings, each said rectangular multi-planar surface comprising a first planar portion and a second planar portion forming a tapered surface meeting at a midline, each said midline comprising a portion of said rectangular multi-planar surface that extends a greatest amount from an interior of said nozzles, said exhaust chamber having a rectangular exhaust opening matching a combined exterior perimeter of said rectangular multi-planar surface, said nozzles being positioned within said exhaust opening at a distance apart to create inter-nozzle gaps between said nozzles, and said exhaust opening being larger than said combined exterior perimeter of said rectangular multi-planar surface of said nozzles and positioned to form an exhaust periphery gap surrounding said combined exterior perimeter of said rectangular multi-planar surface of said nozzles.

11. The printer according to claim 10, each said tapered surface of each said rectangular multi-planar surface directing air from said parallel slot openings to said exhaust periphery gap.

12. The printer according to claim 10, each said first planar portion and each said second planar portion being at an angle relative to one another to direct air from said parallel slot openings to said exhaust periphery gap.

* * * * *